US009484130B2

(12) United States Patent
Metche et al.

(10) Patent No.: US 9,484,130 B2
(45) Date of Patent: Nov. 1, 2016

(54) DEVICE FOR ASSISTING IN THE PRODUCTION OF WIRING HARNESSES

(71) Applicant: Airbus Operations (SAS), Toulouse (FR)

(72) Inventors: Claude Metche, Mons (FR); Michel Teysseyre, Montaigut sue Save (FR)

(73) Assignee: Airbus Operations (SAS), Toulouse (FR)

( * ) Notice: Subject to any disclaimer, the term of this patent is extended or adjusted under 35 U.S.C. 154(b) by 254 days.

(21) Appl. No.: 14/207,992

(22) Filed: Mar. 13, 2014

(65) Prior Publication Data

US 2014/0290050 A1 Oct. 2, 2014

(30) Foreign Application Priority Data

Mar. 26, 2013 (FR) ..... 13 52694

(51) Int. Cl.
*H01R 9/11* (2006.01)
*H01B 13/012* (2006.01)

(52) U.S. Cl.
CPC .... *H01B 13/01245* (2013.01); *Y10T 29/53243* (2015.01)

(58) Field of Classification Search
CPC ..... H01B 13/01245; Y10T 29/53243
See application file for complete search history.

(56) References Cited

U.S. PATENT DOCUMENTS 3,653,411 A 4/1972 Mosher et al.
4,024,545 A * 5/1977 Dowling ..... G06K 15/029 219/121.68
4,190,890 A * 2/1980 Marx ..... H01B 13/01227 29/720
4,923,537 A * 5/1990 Matsushima ..... B29C 44/1271 156/48
5,082,253 A * 1/1992 Suzuki ..... H01B 13/01218 269/45
5,895,889 A * 4/1999 Uchida ..... B60R 16/0207 174/72 A
6,086,037 A * 7/2000 Nagy ..... B29C 33/123 249/164
6,120,327 A * 9/2000 O'Brien ..... B29C 44/12 174/72 A
6,272,746 B1 * 8/2001 Mori ..... B60R 16/0207 269/21
6,946,604 B1 9/2005 Maris
2001/0019478 A1 * 9/2001 Izumi ..... H01B 13/01227 361/826

FOREIGN PATENT DOCUMENTS

EP 0290641 11/1988

OTHER PUBLICATIONS

French Search Report, Oct. 24, 2013.

* cited by examiner

*Primary Examiner* — Minh Trinh
(74) *Attorney, Agent, or Firm* — Greer, Burns & Crain, Ltd.

(57) ABSTRACT

A device for assisting in the production of wiring harnesses. The device includes a board, with a groove that makes it possible to receive cables. The device further includes an arrangement for transporting a cable, including a nozzle making it possible to position the cable in the groove of the board. Further, a control is configured and arranged to drive the displacement of the cable transport arrangement. Also, flexible and resilient holding elements are provided for holding cables in the groove. The holding elements deform to allow the nozzle to pass when the nozzle positions a cable in the groove and then revert to their initial form to hold the cable in the groove.

11 Claims, 6 Drawing Sheets

DEVICE FOR ASSISTING IN THE PRODUCTION OF WIRING HARNESSES

CROSS-REFERENCES TO RELATED APPLICATIONS

This application claims the benefit of the French patent application No. 1352694 filed on Mar. 26, 2013, the entire disclosures of which are incorporated herein by way of reference.

BACKGROUND OF THE INVENTION

The present invention relates to the field of the production of wiring harnesses, in particular wiring harnesses used in aircraft. A wiring harness is made up of a plurality of cables running between at least two connection points. When a harness includes a number of branches, and therefore more than two connection points, each cable of the harness follows a route between two of said connection points and the routes followed by the different cables that make up the harness at least partially cover one another. The different cables running side by side over a same route portion are generally attached together, for example by means of cable ties, in order to guarantee the cohesion of the harness.

The wiring harnesses are generally produced manually by an operator who uses a form board for that. U.S. Pat. No. 3,653,411 describes such a board. The latter comprises a plurality of pins defining the run of the cables of the harness on the board and the operator is thus guided to route the cables between these pins so as to form the harness. The manual production of the harnesses is lengthy to carry out and it would be desirable to be able to automate it so as to increase productivity.

SUMMARY OF THE INVENTION

An object of the present invention is to remedy the abovementioned drawback. It relates to a device for assisting in the production of wiring harnesses, said device comprising a board. This device is noteworthy in that said board comprises a groove suitable for receiving cables and in that the device also comprises:

- means for transporting a cable, comprising a nozzle making it possible to position the cable in the groove of the board;
- control means suitable for driving the displacement of the cable transport means; and
- means for holding cables in the groove, these holding means being flexible so as to be able to be deformed to allow the nozzle to pass when the latter positions a cable in the groove and to then revert to their initial form to hold the cable in the groove.

The device according to the invention therefore makes it possible to automatically place cables in the groove of the board by means of said nozzle. Furthermore, once placed in the groove, the different cables are held in this groove by means of the holding means, until the production of a harness is completed.

According to a first embodiment, the holding means are produced in an elastomer material covering at least a part of the groove. Preferably, the elastomer material comprises a slot in line with the groove.

According to a second embodiment, the holding means comprise at least one brush with bristles that cover at least a part of the groove.

According to a first variant, the cable transport means comprise a moving head securely attached to a framework situated on the top of the board, said moving head supporting the nozzle.

According to a second variant, the cable transport means comprise a robotized arm supporting the nozzle.

Advantageously, the device for assisting in the production of wiring harnesses also comprises cable cutting means.

Also advantageously, the device for assisting in the production of wiring harnesses also comprises laser marking means.

In a particular embodiment, the groove comprises channels suitable for facilitating the fitting of cable ties around the cables contained in said groove.

BRIEF DESCRIPTION OF THE DRAWINGS

The invention will be better understood on reading the following description and on examining the appended figures.

DETAILED DESCRIPTION OF THE PREFERRED EMBODIMENTS

Figure 1:
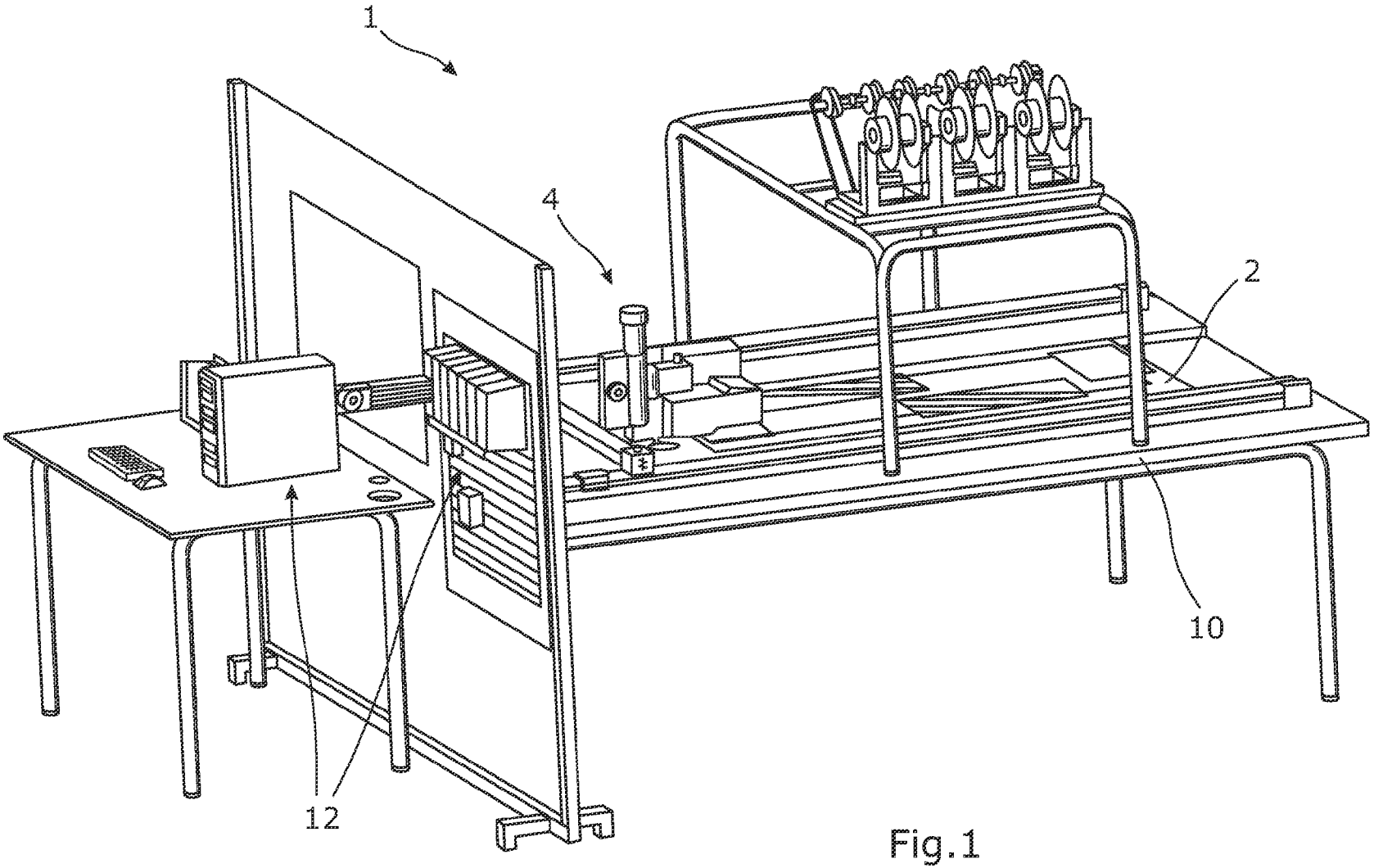
FIG. 1 represents, from a perspective view, a device for assisting in the production of harnesses according to an embodiment of the invention.

The device 1 for assisting in the production of wiring harnesses represented in FIG. 1 comprises a board 2 placed on a substantially horizontal table 10. Preferably, the board is produced in a plastic material, for example polymethylmethacrylate (PMMA) or polytetrafluoroethylene (PTFE). Other types of materials are, however, possible without departing from the framework of the invention. Cable transport means 4 are also arranged on this table. The device 1 also comprises control means 12 suitable for driving the displacement of the cable transport means 4. As represented in more detail in FIGS. 2, 3*a* and 3*b*, the board 2 comprises at least one groove 8. This groove is suitable for receiving cables. It is covered, at least partly, by means 6 for holding cables in said groove. These means 6 can, for example, be produced in an elastomer material comprising a slot in line with the groove. The thickness of the elastomer material is preferably between 1 and 4 millimeters. In a first embodiment, the means 6 correspond to a sheet of elastomer material covering the whole of the board 2, for example glued onto the latter. In another embodiment, as represented in FIGS. 1, 2, 3*a* and 3*b*, the holding means 6 correspond to a set of plates of elastomer material distributed on the board 2 and covering certain parts of the groove 8. The groove has at least two ends, each corresponding to connection points for the cables forming the harness. For example, in FIG. 3*a*, five ends E1, E2, E3, E4 and E5 are provided, whereas in FIG. 3*b*, three ends E'1, E'2 and E'3 are provided. A same board can have a number of grooves: for example the board represented in FIG. 3*a* has two grooves 8 and 8*a*, which makes it possible to produce two harnesses. In this figure, the two grooves 8 and 8*a* are of similar forms, therefore corresponding to the production of two harnesses of the same type. However, it is also possible to provide, on a same board, a number of grooves of different forms corresponding to different types of harnesses. Preferably, the groove 8 comprises channels 9. These channels 9 are produced in a plane at right angles to a longitudinal axis of the groove, so as to facilitate the fitting of cable ties around the cables of the harness.

Figure 2:
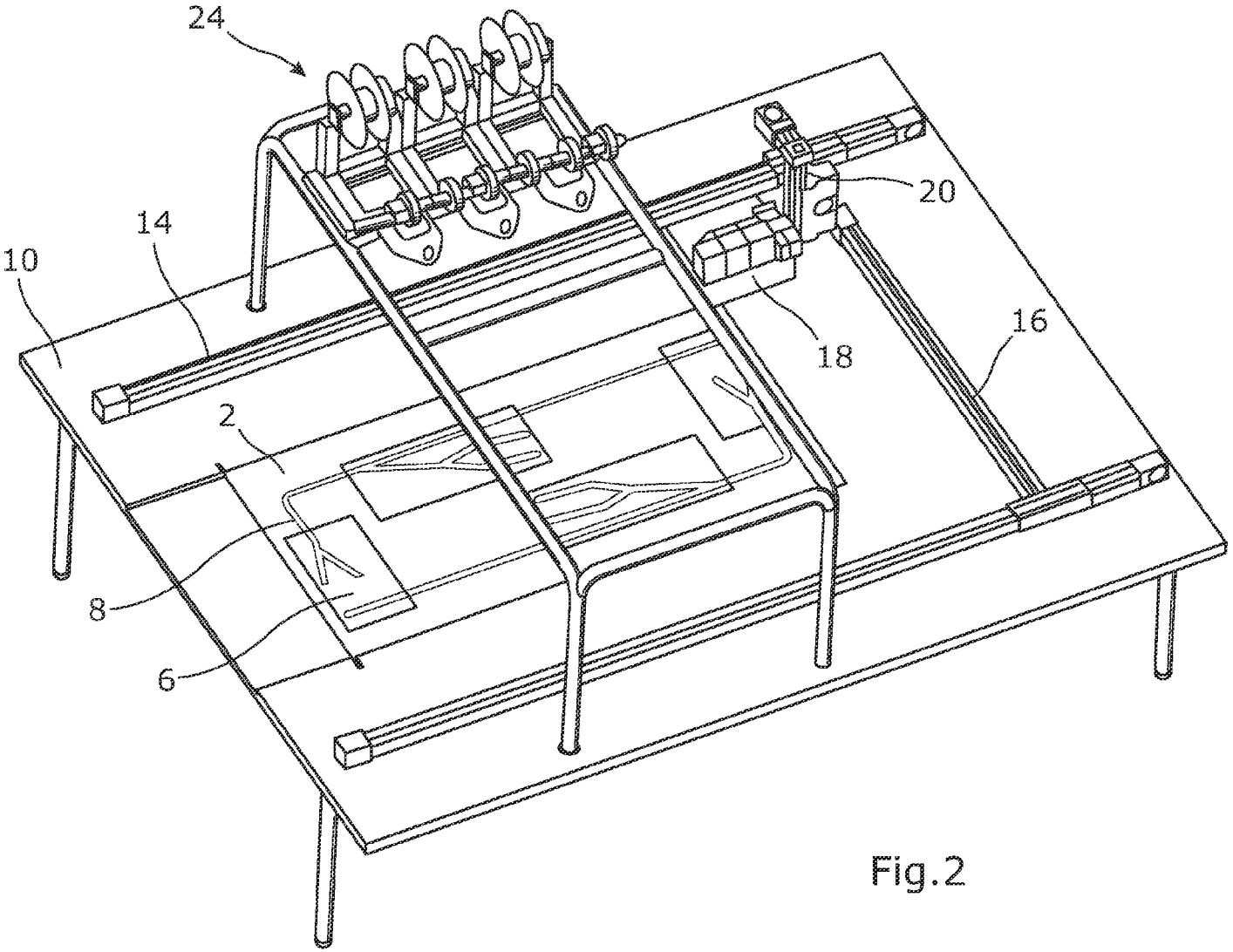
FIG. 2 represents, from another perspective view, a part of the device represented in FIG. 1.
Figure 4:
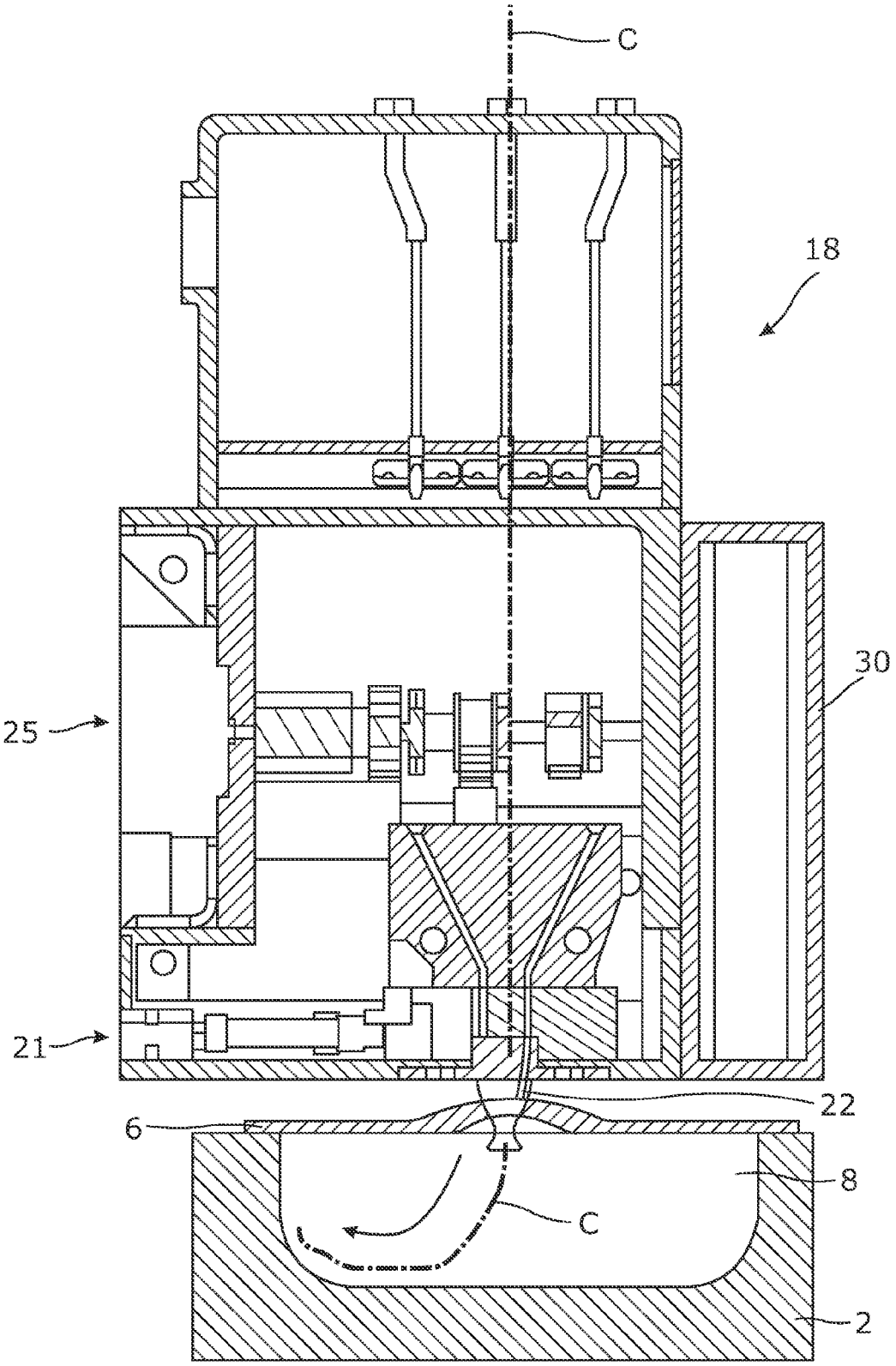
FIG. 4 represents a vertical cross-sectional view of a part of the device represented in FIGS. 1 and 2.

In a first variant represented in FIG. 2, the cable transport means 4 comprise a three-axis framework. The latter comprises two parallel rails 14 securely attached to the table 10, and a motorized rail 16 suitable for being displaced in translation on the two rails 14. For its part, a motorized carriage 20 can be displaced in translation on the motorized rail 16. This carriage 20 also makes it possible to displace, in vertical translation, a head 18 securely attached to said carriage. This head 18 comprises a nozzle 22, and cable driving means 25, as represented in FIG. 4. These driving means 25 can, for example, comprise wheels or rollers, likely to drive the cable by friction. Advantageously, the head 18 also comprises cable cutting means 21. Also advantageously, the head 18 also comprises laser marking means 30 for marking the cable. The device 1 also comprises cable feeding means 24. These means 24 can, for example, correspond to a set of payout devices suitable for receiving reels of cables as represented in FIG. 2. The means 24 can, for example, be placed on the table 10. The availability of a number of payout devices makes it possible to produce harnesses comprising cables of several types corresponding to different characteristics, each reel corresponding to a cable type.

Figure 3A:
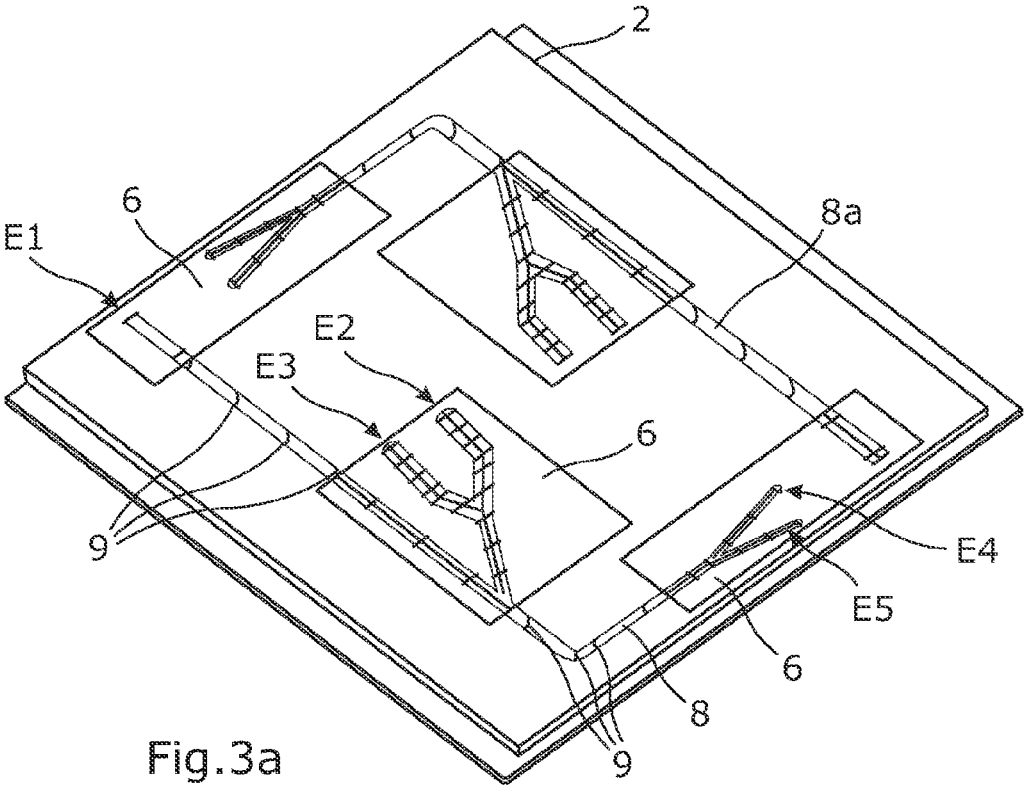
FIGS. 3*a* and 3*b* represent, from perspective views, two exemplary boards of the device represented in FIGS. 1 and 2.
Figure 3B:
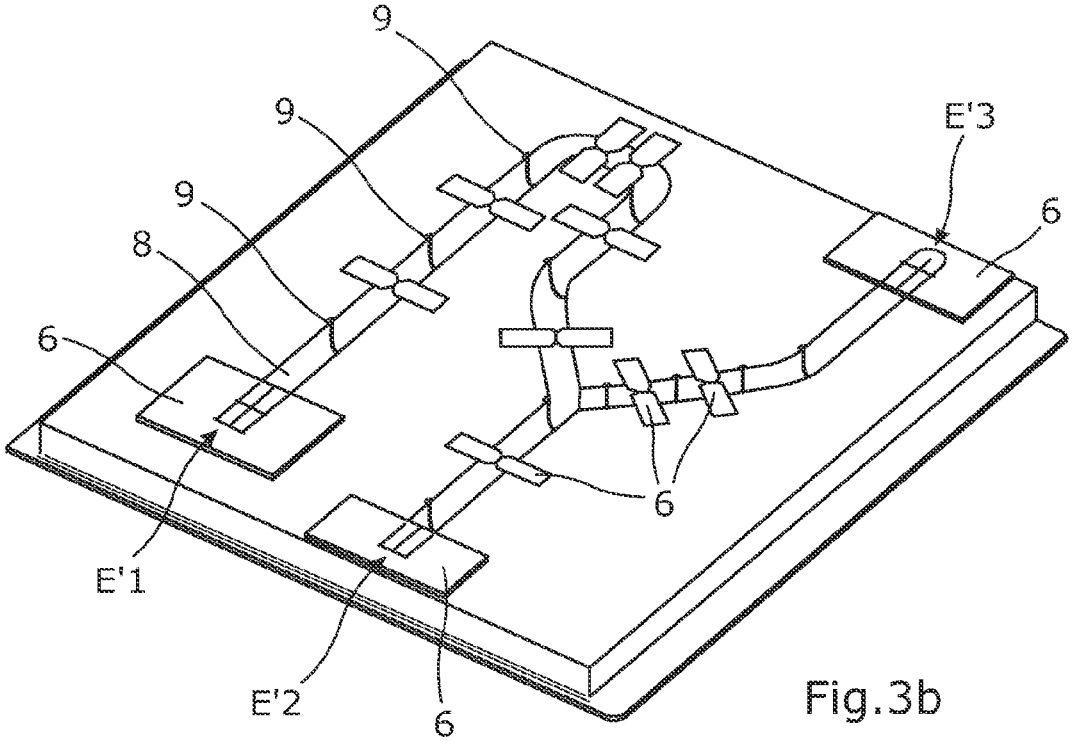

The control means 12 comprise a computer with a memory that contains information relating to at least one type of harness that is to be produced. In operation, based on said information, the computer sends instructions to the transport means 4 so as to drive the displacements of said transport means. Each cable forming the harness must generally be arranged between two ends of the groove in which it is placed. Before a cable is positioned in the groove, when the suitable cable type is not inserted in the head 18 and the nozzle 22, the computer controls the displacement of the transport means 4 so as to bring the head 18 into proximity with the cable feeding means 24. The computer then automatically controls the insertion into the head 18 and the nozzle 22, of the appropriate cable type, available on one of the payout devices of said cable feeding means 24. This automatic insertion of the cable into the head 18 and the nozzle 22 can be performed, for example, by a clamp controlled by the computer. Without departing from the framework of the invention, the insertion of the cable into the head 18 and the nozzle 22 could also be performed manually by an operator. When the suitable cable type is placed in the head 18 and the nozzle 22, the computer controls the positioning of the cable in the groove. As an illustration, the example of a cable having to be placed between the ends E1 and E5 of the groove 8 of FIG. 3*a* is considered here. For this, the computer controls the displacement of the transport means 4 so as to bring the nozzle 22 in line with the end E1 of the groove 8, then it controls a vertical displacement of the head 18 so as to engage the nozzle 22 in said end of the groove. Since the end E1 is covered by the cable holding means 6, produced in an elastomer material comprising a slot in line with the groove, the nozzle 22 penetrates into the groove 8 through this slot, by deforming the elastomer material. The computer then controls the transport means 4 so as to generate a horizontal displacement of the nozzle 22 in the groove 8, to the end E5. The computer simultaneously controls the cable driving means 25 of the head 18 in such a way that the speed at which the cable leaves the nozzle 22 corresponds to the linear speed of displacement of the nozzle in the groove. This makes it possible to place the cable in the groove, a first end thereof remaining at the end E1 of the groove. Furthermore, the holding means 6 make it possible to guarantee that the cable does indeed remain inside the groove. Simultaneously with the positioning of the cable in the groove, the computer controls the laser marking means 30, to produce a desired marking of the cable in synchronism with the driving of the cable by the means 25. The computer controls the cable cutting means of the head 18 in such a way that a second end of the cable, resulting from said cutting of the cable, is positioned substantially at the end E5 of the groove. For this, the cutting of the cable is advantageously anticipated, during the displacement of the nozzle in the groove between the ends E1 and E5, at a point of the groove situated at a distance of E5 corresponding to the distance traveled by the cable in the head 18 between the cutting means 21 and the nozzle 22. The computer then controls a vertical displacement of the head 18 so as to extract the nozzle 22 from the groove. This process is repeated as many times as are necessary, until all of the cables of the harness are placed in the groove. An operator can then place the cable ties around the cables of the harness, so as to hold the various cables together in the desired conformation. For this, he or she fits the cable ties into the channels 9. Each channel 9 allows a cable tie to circulate around all the cables contained in the groove at the position of said channel.

Figure 5:
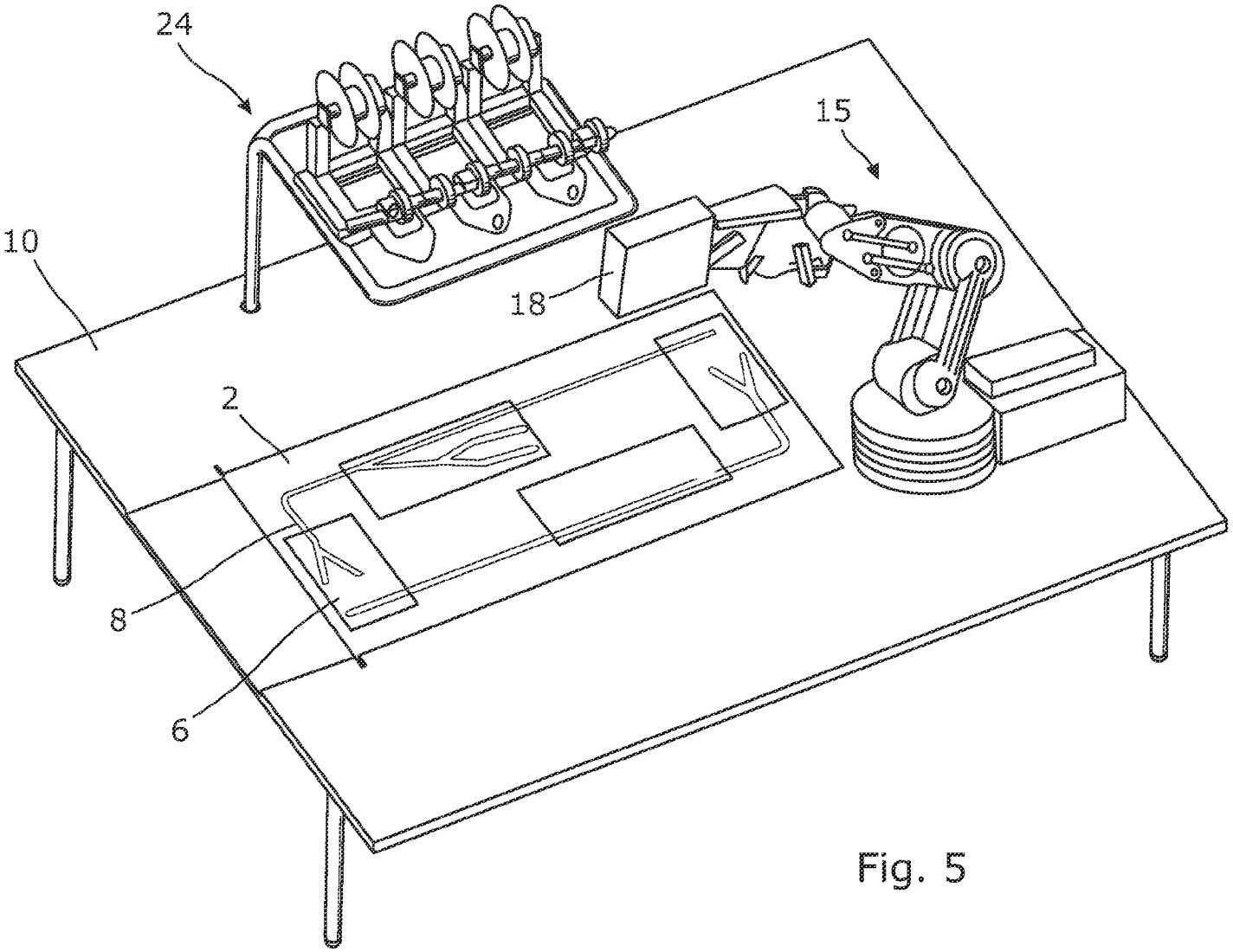
FIG. 5 represents, from a perspective view, a variant of the device represented in FIG. 2.

In a second variant, represented in FIG. 5, the cable transport means 4 comprise a robotized arm 15, one end of which bears the head 18 already described, and therefore the nozzle 22. The method for producing a harness is similar to that already described, except that the displacements of the nozzle 22 are performed by the robotized arm 15, controlled by the computer.

Figure 6A:
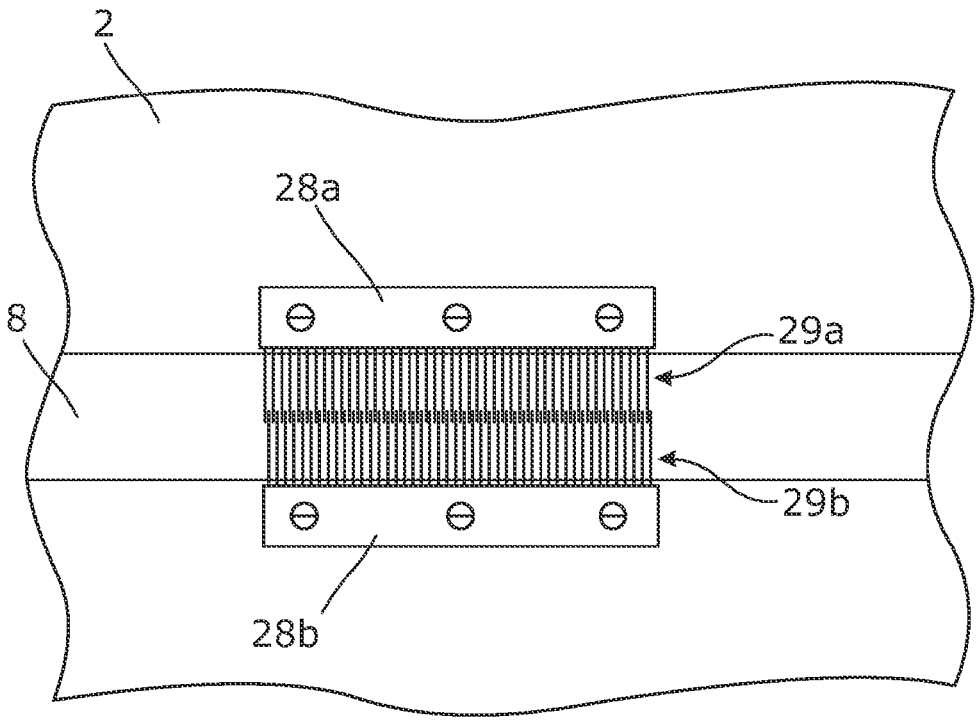
FIGS. 6*a* and 6*b* represent, from a plan view, a part of a board provided with cable holding means according to a particular embodiment of the invention.
Figure 6B:
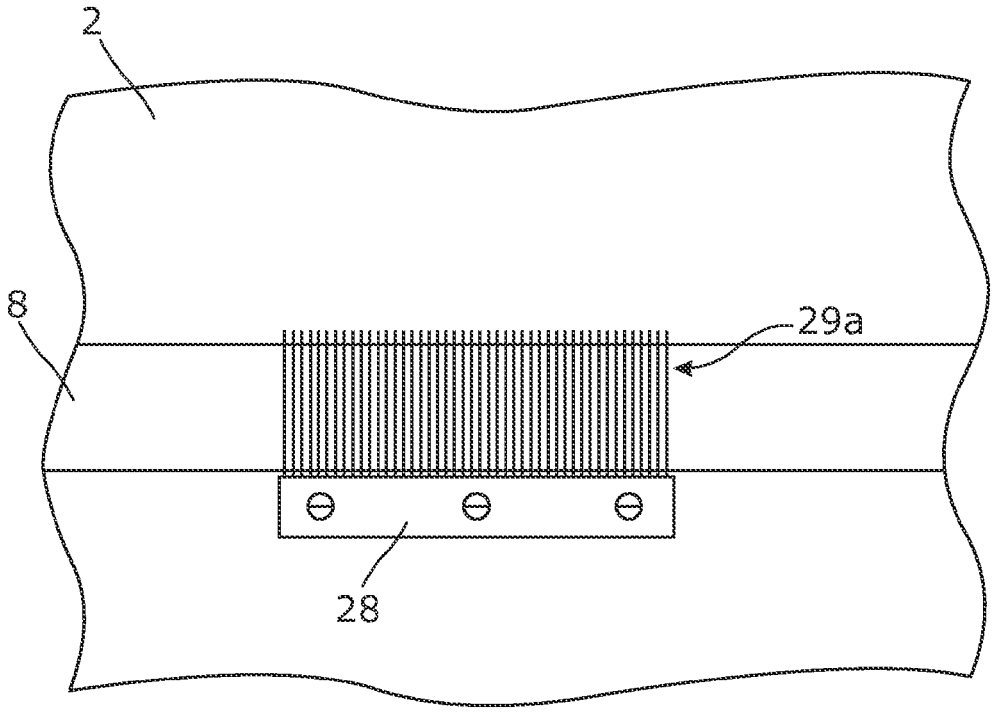

The invention has been described in the case where the cable holding means 6 are produced in an elastomer material comprising a slot in line with the groove. Other holding means can be envisaged, for example brushes with bristles that cover at least a part of the groove 8. According to a first embodiment represented in FIG. 6*a*, two brushes 28*a* and 28*b* are placed on the top surface of the board 2, in line with one another, on either side of the groove 8. The bristles 29*a* and 29*b* of the two brushes meet substantially above the groove, so as to hold the cables in the groove. The flexibility of the bristles allows for the engagement and the circulation of the nozzle 22 in the groove. According to another embodiment represented in FIG. 6*b*, a brush 28 is placed on one side of the groove and its bristles 29 are long enough to cover all the width of the groove. Other arrangements or other holding means can be envisaged without departing from the framework of the invention.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A device for assisting in the production of wiring harnesses, said device comprising:

a board having a groove suitable for receiving cables;

a transport element comprising a nozzle configured and arranged to transport a cable and to position the cable in the groove of the board;

a control configured and arranged to drive the displacement of the cable transport nozzle; and flexible and resilient holding elements configured and arranged to hold the cables in the groove, these holding elements being deformable and configured to allow the nozzle to pass therethrough when the nozzle positions a cable in the groove and to then revert to their initial form to hold the cable in the groove.

2. The device as claimed in claim 1, wherein the holding elements comprise an elastomer material covering at least a part of the groove.

3. The device as claimed in claim 2, wherein the elastomer material comprises a slot in line with the groove.

4. The device as claimed in claim 1, wherein the holding elements comprise at least one brush with bristles that cover at least a part of the groove.

5. The device as claimed in claim 1, wherein the cable transport element further comprises a moving head securely attached to a framework situated on the top of the board, said moving head supporting the nozzle.

6. The device as claimed in claim 1, wherein the cable transport element further comprises a robotized arm supporting the nozzle.

7. The device as claimed in claim 1, further comprising cable cutting device.

8. The device as claimed in claim 1, further comprising a laser marking means element.

9. The device as claimed in claim 1, wherein the groove comprises channels configured and arranged to facilitate the fitting of cable ties around the cables contained in said groove.

10. A device for assisting in the production of wiring harnesses, said device comprising:

a board having a groove configured to receive at least one cable;

a transport element comprising a nozzle configured and arranged to extend into the groove and position the at least one cable in the groove of the board;

a control configured and arranged to drive the displacement of the nozzle; and, flexible and resilient holding elements disposed on top of the groove and configured to allow the nozzle to pass therethrough when the nozzle positions a cable in the groove and to then revert to their initial form to hold the cable in the groove.

11. A device for assisting in the production of wiring harnesses, said device comprising:

a board having a groove configured to receive at least one cable;

a transport element comprising a nozzle configured and arranged to extend into the groove and position the at least one cable in the groove of the board;

a control configured and arranged to drive the displacement of the nozzle; and, flexible and resilient holding elements covering a portion of a top of the groove and configured to allow the nozzle to pass therethrough when the nozzle positions a cable in the groove and to then revert to their initial form to hold the cable in the groove, and wherein the flexible and resilient holding elements comprise an elastomer material having a slot in line with the groove.

* * * * *